US008782819B1

(12) United States Patent
Culpepper

(10) Patent No.: US 8,782,819 B1
(45) Date of Patent: Jul. 22, 2014

(54) SPIDER WEB PROTECTIVE INSERTS FOR A FOOTBALL HELMET OR THE LIKE

(76) Inventor: Thomas C. Culpepper, Virginia Beach, VA (US)

( * ) Notice: Subject to any disclaimer, the term of this patent is extended or adjusted under 35 U.S.C. 154(b) by 0 days.

(21) Appl. No.: 13/374,497

(22) Filed: Jan. 3, 2012

Related U.S. Application Data

(60) Provisional application No. 61/519,067, filed on May 16, 2011.

(51) Int. Cl.
*A42B 3/00* (2006.01)
*A42B 1/06* (2006.01)
*A63B 71/10* (2006.01)

(52) U.S. Cl.
USPC ..... 2/411; 2/410; 2/425

(58) Field of Classification Search
USPC ..... 2/272, 410, 411, 412, 413, 414, 415, 2/416, 421, 425
See application file for complete search history.

(56) References Cited

U.S. PATENT DOCUMENTS

| | | | | | |
|---|---|---|---|---|---|
| 2,286,843 | A * | 6/1942 | Catalane et al. | ..... | 2/410 |
| 2,391,335 | A * | 12/1945 | O'Brien | ..... | 2/425 |
| 2,688,204 | A * | 9/1954 | Laubhan | ..... | 43/12 |
| 2,784,408 | A * | 3/1957 | Moore | ..... | 2/411 |
| 3,205,508 | A * | 9/1965 | Cox | ..... | 2/410 |
| 3,735,418 | A * | 5/1973 | Kavanagh et al. | ..... | 2/416 |
| 3,784,984 | A * | 1/1974 | Aileo | ..... | 2/423 |
| 4,982,451 | A | 1/1991 | Graham | | |
| 5,915,537 | A * | 6/1999 | Dallas et al. | ..... | 2/410 |
| 6,880,176 | B2 | 4/2005 | Timms et al. | | |
| 7,100,490 | B2 * | 9/2006 | Muller, Jr. | ..... | 89/36.02 |
| 7,841,025 | B1 | 11/2010 | Fink et al. | | |
| 2003/0008584 | A1 * | 1/2003 | Thomas | ..... | 442/240 |
| 2007/0220663 | A1 | 9/2007 | Picotte | | |
| 2010/0107317 | A1 * | 5/2010 | Wang | ..... | 2/411 |

OTHER PUBLICATIONS

Trey Dunn. "Spiders on Drugs". URL: <http://www.trinity.edu/jdunn/spiderdrugs.htm>. Published before Aug. 1, 2004 (via web.archive.org—"Wayback Machine").*

* cited by examiner

*Primary Examiner* — Alissa L Hoey
*Assistant Examiner* — Jameson Collier
(74) *Attorney, Agent, or Firm* — William G. Sykes

(57) ABSTRACT

A protective component for use within a protective helmet such as a football helmet that includes one or more spider web-like structures formed from a fine but strong polymeric fiber, preferably artificial spider web silk. The one or more spider web layers are spaced apart one from another as well as from any conventional padding foam lining the hard shell of a helmet. The web layer or layers is/are independently attached to the helmet shell, generally by their edges. The innermost web layer surrounds and conforms to a wearer's head. The spider web elements provide excellent protection to the head of a wearer of the protective helmet. The use of the inventive web layers allows the production of fewer helmet sizes while still resulting in a perfect conformal fit to a wide range of head sizes and/or shapes within a particular helmet size.

16 Claims, 5 Drawing Sheets

SPIDER WEB PROTECTIVE INSERTS FOR A FOOTBALL HELMET OR THE LIKE

RELATED APPLICATIONS

This application claims priority under 37 C.F.R. §1.119(e) to U.S. Provisional Patent Application No. 61/519,067 for SPORT'S HELMET PADDING COVERED WITH SPIDER WEB TECHNOLOGY, filed May 16, 2011 and which is incorporated herein in its entirety by reference.

FIELD OF THE INVENTION

The invention pertains to sports helmets and, more particularly, to one or more protective layers incorporating a spider web-like structure for inclusion within a football helmet or the like.

BACKGROUND OF THE INVENTION

Currently, the news abounds with yet another story of head or neck injuries incurred by a participant in a sport such as football or while engaging in other recreational activities. Similar injuries are common among operators of equipment such as motor cycles, all terrain vehicles (ATV's), snow machines or snow mobiles, or other similar equipment. Still other styles of protective headgear are worn by on the job by workers in certain jobs.

As used herein, the term protective headgear will be applied to all protective helmets suitable for use in work, athletic endeavors or while operating motorcycles or other such devices. While a football helmet is used herein for purposes of disclosure, it will be recognized that many other forms of protective headgear may incorporate the novel spider web structures of the present invention. Therefore, for the sake of brevity, the term football helmet is used hereinafter to represent all such protective headgear.

There are many types of protective headgear known in the prior art. For such headgear to be effective in protecting a wearer thereof, it must fit properly. For wide acceptance by persons in need of head/neck protection, such headgear must be comfortable when worn. Such headgear typically uses padding applied to a hard outer shell to cushion the wearer's head from impacts Human heads come in a wide variety of sizes and shapes. Manufacturers of such headgear must, therefore, provide headgear in a wide range of sizes and styles to properly protect this variety of head sizes and shapes.

A typical protective helmet consists of a hard, molded, polymeric outside shell with a molded foam padded insert sized and shaped to conform to a specific head size and shape. This construction creates manufacturing inefficiencies because manufacturers have heretofore needed to provide tooling (e.g., molds) to produce molded padding inserts to fit these aforementioned diverse head styles and shapes. Even with a range of sizes available in each style helmet produced, a perfect fit was not obtained by many users of the helmets of the prior art.

During the early twenty-first century, deaths of professional football players began to be linked to multiple concussions received during those players' playing careers. In response to allegations being made that the current generation of football helmets were not providing the protection advertised by their manufacturers, United States Senator Thomas Udall urged the Federal Trade Commission (FTC) in the United States to look at the problem of concussions received by football players. Specifically, Senator Udall asked the FTC to investigate "misleading safety claims and deceptive practices" of football helmet manufactures. [New York Times, Jan. 4, 2011, Page B10] In early 2011 the FTC announced that it would independently test the safety claims made by manufacturers of football helmets.

As awareness of the possible inadequacy of football helmets to properly protect players of the game spread, many questions began to be raised as to how protective helmets could be improved. The novel spider web-based technology of the present invention offers an answer to how to better protect the heads and necks of helmet wearers (e.g., football players) exposed to impacts to the head and neck region of their bodies.

DISCUSSION OF THE RELATED ART

Attempts at improving helmets such as football helmets may be found in the prior art. For example, U.S. Pat. No. 4,982,451 for HEAD COVERING DEVICE issued Jan. 8, 1991 to Richard T. Graham teaches a head covering device having a resilient adjustable liner with a deformable fabric crown removably attached thereto.

U.S. Pat. No. 6,880,176 for HEADGEAR issued Apr. 19, 2005 to Richard M. Timms et al. provides improved headgear having an outer shell and an inner liner providing a head receiving cavity. A headband has a forward portion and lateral portions secured to the inner liner and a rearward portion extending rearwardly of said lateral portions.

United States Published Patent Application No. 2007/0220663 for HEAD PROTECTOR FOR INFANTS, SMALL CHILDREN, SENIOR CITIZENS, ADULTS OR PHYSICALLY DISABLED INDIVIDUALS published Sep. 27, 2007 upon application by Brooke Picotte teaches a protective hat having a cap member and one or more flexible, resilient shock absorbent pads. The cap member may be constructed so as to fully enclose and/or encapsulate the one or more pads.

U.S. Pat. No. 7,841,025 for JAW PAD COVER issued Nov. 30, 2010 to Joshua M. Fink et al. discloses a jaw pad cover for expandably conforming to a shape of a jaw pad for protectively covering the jaw pad of a headgear. The jaw pad cover has a stretchable material blank having a first section and a second section joined together with a stitch.

None of the patents nor the published patent application, taken singly, or in any combination is seen to teach or suggest the novel spider web protective structures of the present invention.

SUMMARY OF THE INVENTION

In accordance with the present invention there is provided one or more spider web-like structure formed from a fine but strong polymeric fiber. The one or more spider web structures are spaced apart one from another as well as from any conventional padding foam lining the hard shell of a helmet. The web layer or layers is/are independently attached to the helmet shell, generally at the perimeter edge of the spider wed structures. The innermost web layer surrounds and conforms to a wearer's head. The use of the inventive web layers allows the production of fewer helmet sizes while still resulting in a perfect conformal fit to a wide range of head sizes and/or shapes within a particular helmet size. Helmets may, therefore, be provided in only a few sizes, each helmet size accommodating a broad range of head sizes and/or shapes.

It is, therefore, an object of the invention to provide a protective helmet incorporating one or more spider web-like structures spaced apart from one another and from other padding components.

It is another object of the invention to provide a protective helmet incorporating one or more spider web-like structures wherein each spider web-like structure is independently attached to the hard outer shell of the helmet.

It is an additional object of the invention to provide a protective helmet incorporating one or more spider web-like structures where two spider web-like structures are spaced apart from one another a distance in the range of approximately one inch.

It is a further object of the invention to provide a protective helmet incorporating one or more spider web-like structures wherein an inner spider web-like structure surrounds and conforms to the outside of the head of a wearer of the helmet.

It is a still further object of the invention to provide a protective helmet incorporating one or more spider web-like structures utilize fastening systems that allow any spider web structure to be selectively removed from the protective helmet.

It is yet another object of the invention to provide a protective helmet incorporating one or more spider web-like structures to provide a fastening system to permanently secure the spider web structures within the protective helmet.

It is an additional object of the invention to provide a protective helmet incorporating one or more spider web-like structures that use resilient tethers disposed between an outside surface of the one or more spider web structure and an inner surface of the protective helmet.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

Figure 1:
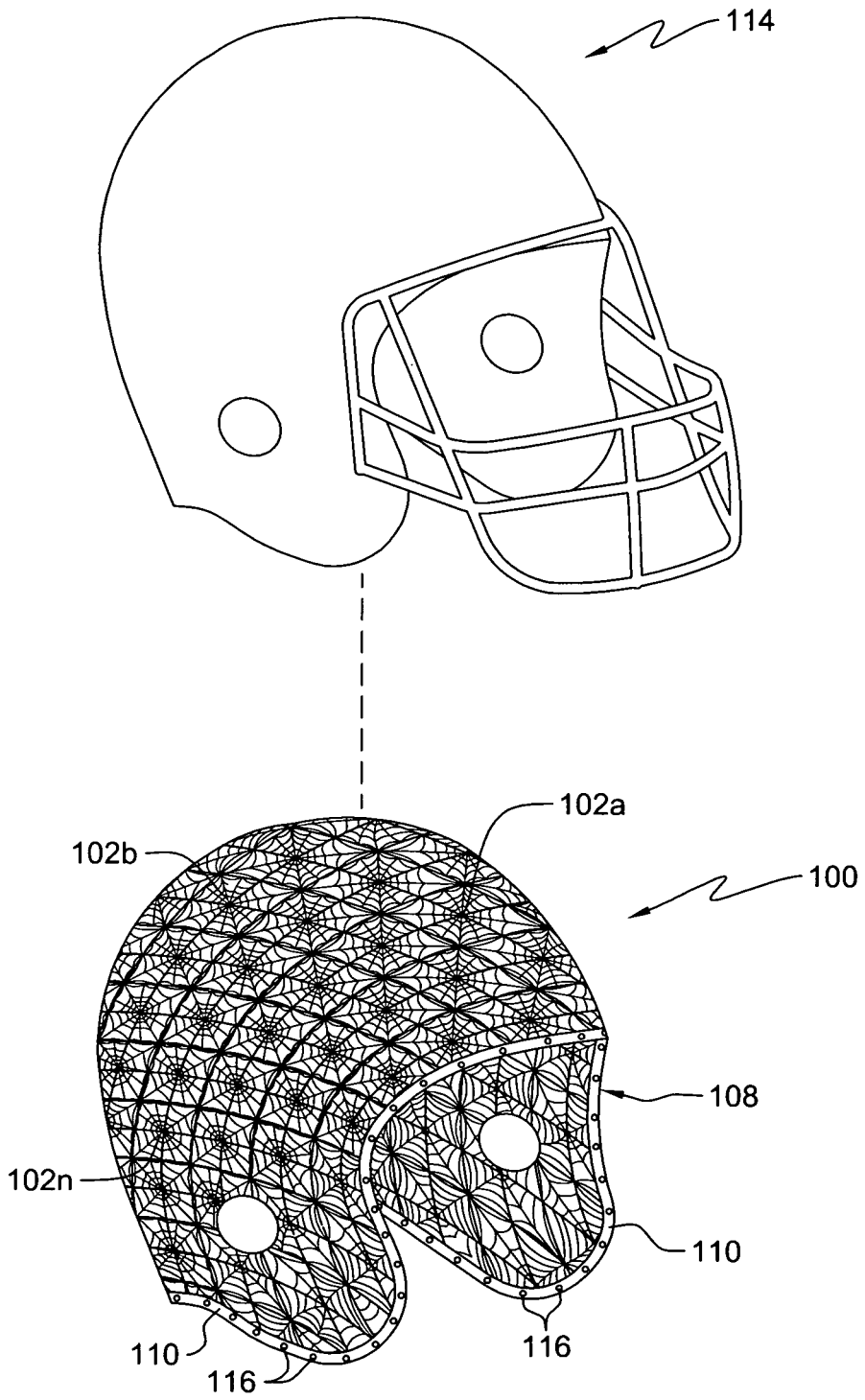
FIG. 1 is an exploded, perspective, schematic view of a first spider web structure of the invention shown adjacent a helmet shell and poised for insertion thereinto.

The present invention provides a protective element consisting of one or more spider web structures for use in protective headgear. The spider web structure(s) replace conventional internal padding. For simplicity, the term "football helmet" will be used hereinafter to refer to any type of protective headgear typically using internal padding to protect the head and or neck of a wearer thereof from bodily injury from external impact to the head and/or upper neck. While a football helmet has been used for purposes of illustration and disclosure, it will be recognized that the spider web structures of the invention may be modified to work with virtually any protective helmet.

The protective "padding" and restraint element of the invention consists of a first spider web-like structures conformally surrounding a wearer's head, surrounded by a second, spider web-like structure spaced apart therefrom. The first and second spider web structures surround and envelope the head of a wearer of a helmet incorporating the web structures. Such web structures may be formed from a relatively new product, artificial spider web silk. Artificial silk has both great strength and flexibility.

While humans have relied on silk for more than 2,000 years, scientists have herebefore not been able to unravel the mystery of how spiders and silkworms produced their strong fibers. Researchers have now discovered the mechanism for producing strong natural silk, providing critical new information about nature's strongest fiber. Spider silk is among the toughest materials known, but it is not entirely unique. It is merely one of the most dramatic examples of a sizable family of biopolymers that can teach much about how to improve upon man-made products. In many cases the biopolymers possess a combination of properties that synthetic materials cannot yet provide. Basically, the concept is to copy, to the extent possible, the way that nature manufacturers products (i.e., biosynthesis). Artificial spider web silk is an excellent example of such a man-made material. The polymeric component materials existing at the time of the first invention of artificial spider silk were Kevlar® and nylon. Kevlar® is a strong but inflexible para-aramid synthetic material while nylon is a polyamide synthetic material that is flexible but not very strong. It will be recognized that ongoing research is expected to provide even stronger, more flexible artificial silk materials in the future. Consequently, the invention is not considered limited to the Kevlar®/nylon blend used for purposes of disclosure. Rather, the invention is intended to include any artificial or natural fiber exhibiting properties of strength and flexibility allowing web or net structures to be formed therefrom.

One or more web structures, typically spaced apart from one another may be incorporated into a helmet. Typically, the first, inner web structure contacts the head of the helmet wearer. When more than one web structure is incorporated into the helmet, a second web surrounds the first web and is spaced apart therefrom. Each web structure is independently attached, typically removably attached, to the outer hard helmet shell or to some fitting directly attached thereto.

Referring first to FIG. 1, there is shown a perspective, exploded view of a typical inner web structure poised for insertion into a modified conventional helmet of the prior art, generally at reference number 100.

Web structure 100 typically consists of a plurality of small "spider webs" 102*a*, 102*b* . . . 102*n* held together at their edges. As may readily be seen in FIG. 1, each spider web 102*a*, 102*b* . . . 102*n* mimics a web formed in nature by a silk-spinning spider. Typically, a natural spider web has a number of spaced apart strands radiating outward from a central point of the web connected together by a series of spaced apart strands, typically forming polygonal figures of ever increasing size but centered on the central point. Web structure 100 may be constructed from any desired number of spider webs 102*a*, 102*b* . . . 102*n* and spider webs 102*a*, 102*b* . . . 102*n* may be all of one size or, in alternate embodiments spider webs 102*a*, 102*b* . . . 102*n* may be of different sizes. Each of spider webs 102*a*, 102*b* . . . 102*n* is ideally made from an artificial silk material.

Figure 2:
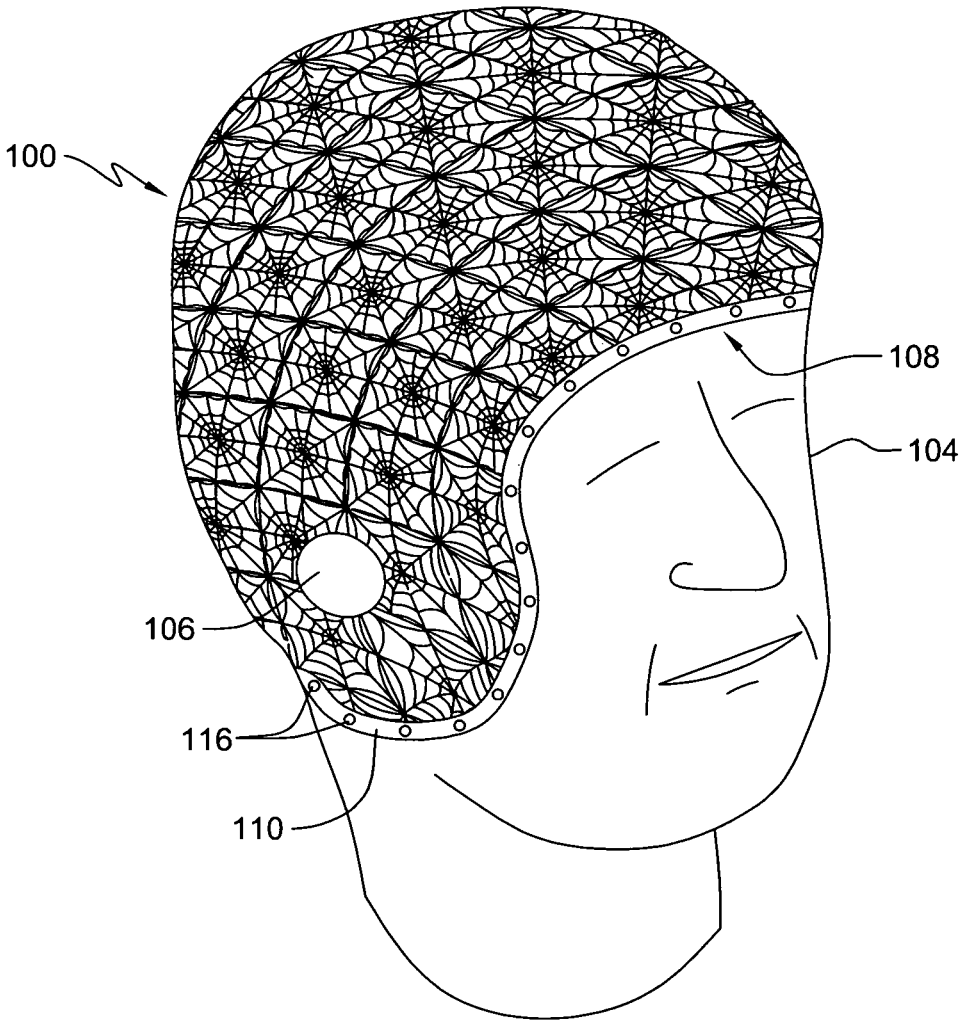
FIG. 2 is a perspective, schematic view of the spider wed structure of FIG. 1 installed on the head of a helmet wearer.

Regardless of the configuration of spider webs 102*a*, 102*b* . . . 102*n*, web structure 100 is constructed to be somewhat smaller than the head 104 of an intended wearer, best seen in FIG. 2. The resiliency of web structure 100 will accommodate a wide range of head 104 sizes. It will be recognized that human head 104 forms no part of the present invention and is included merely to illustrate we structure 100 in its intended operating environment.

Holes 106 may be left in web structure 100 as required to accommodate a helmet feature, none of which are shown.

All or some of the perimeter edge 108 of web structure 100 may be reinforced with bias tape (sometimes referred to as bias binding) 110 or another reinforcing edge treatment. One method for attaching bias tape 110 to web structure 100 is by folding bias tape 110 over perimeter edge 108 and then stitching through both a front and rear layers of bias tape 110 along a major axis of bias tape 110, thereby trapping and securing perimeter edge 108 therebetween. Both bias tape 110 and its installation are believed to be well known to those of skill in the art. Consequently, neither is further described nor discussed herein.

A perimeter edge 108 reinforced with bias tape 110 or a similar structure provides many options for connecting web structure 100 to an appropriate inside surface 112 of a football helmet 114. It is preferable but not necessarily mandatory that web structure 100 be removably installed in football helmet 114. The use of connecting elements 116 such as snaps, one or more zippers, a hook-and-loop fastening system, or other similar fastening elements allows installation and removal of web structure 100. If removability of web structure 100 from helmet 114 is not required, a permanent fastening method such as an adhesive, stitching, ultrasonic welding, or any other suitable permanent fastening system, none of which are shown, but all believed to be known to those of skill in the art may be utilized.

Figure 3:
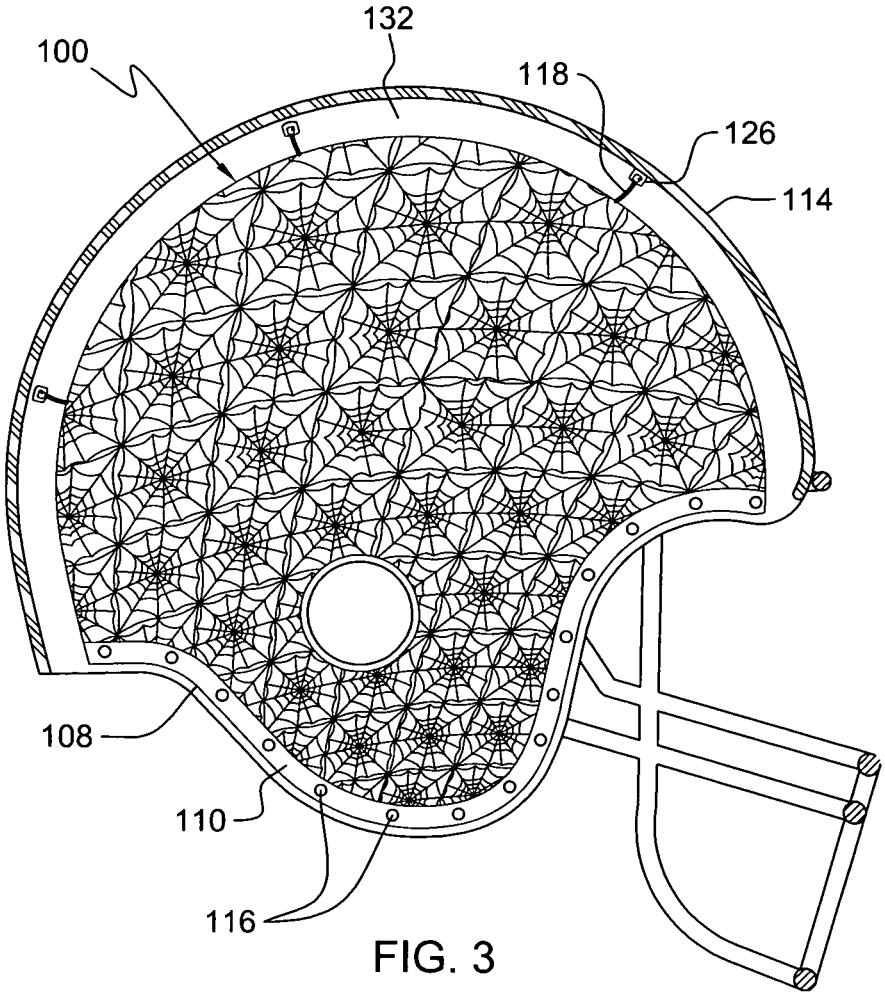
FIG. 3 is a side elevational, cross-sectional, schematic view of the spider web structure of FIG. 1 installed in the helmet of FIG. 1.
Figure 6A:
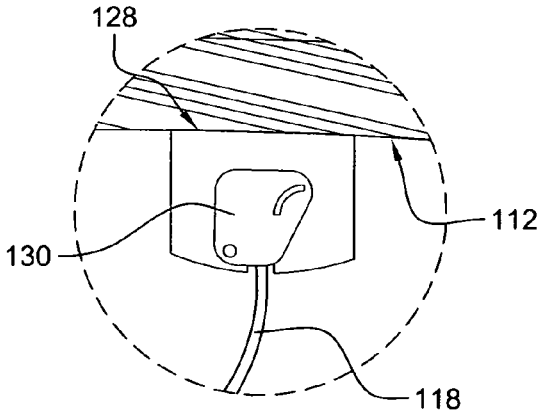
FIGS. 6*a* and 6*b* are side, elevational, schematic view of a mechanism for attachment to an inside surface of a helmet to secure a distal end of a resilient tether thereto in a locked and an open configuration, respectively.
Figure 6B:
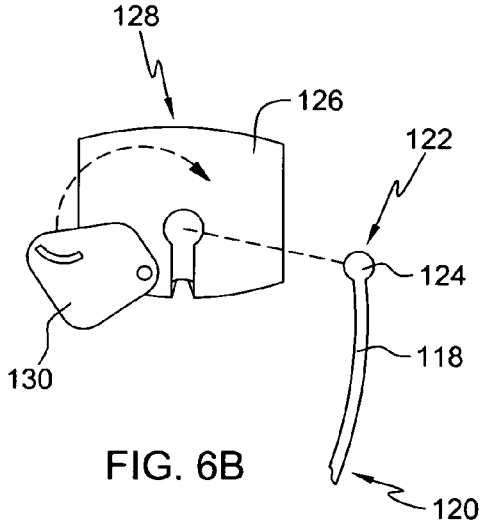

Referring now to FIG. 3, there is shown a side elevational, cross-sectional, schematic view of web structure 100 installed in a football helmet 114. While it is anticipated that web structure 100 may be retained in helmet 114 only by its perimeter edge 108, it is possible that for some applications or for some types of helmet that additional interconnections to helmet 114 will be required. Such connections are generally resilient tethers 118 having a proximal end 120 connected to the surface of web structure 100 at any desired point on its outer surface. A distal end 122 of resilient tether 118 may be connected to an inside surface 112 of helmet 114 by receptacles 126 as best seen in FIGS. 6*a* and 6*b*. Resilient tethers 118 may be used to hold a selected portion of web structure 100 in a predetermined spatial relationship to helmet 114. Resilient tethers 118 are ideally formed from artificial spider silk because of the mechanical properties thereof already discussed. It will be recognized, however, that other resilient materials may be substituted. Consequently, the invention is not considered limited to the artificial spider silk chosen for purposes of disclosure. Rather, the invention in intended to include any other suitable material.

An air gap 132 is formed between web structure 150 and an inner surface 112 of helmet 114.

Figure 4:
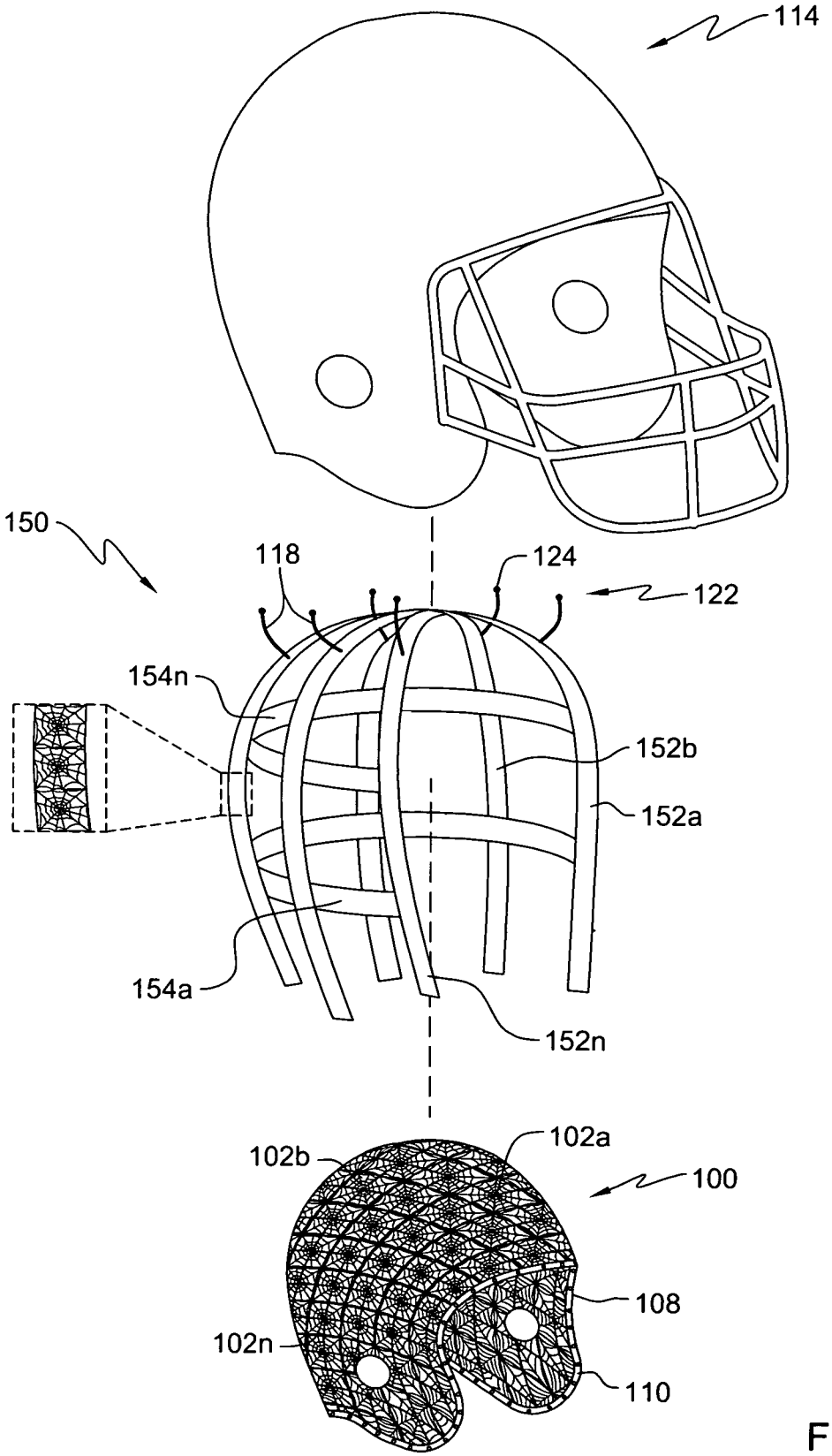
FIG. 4 is an exploded, perspective, schematic view of the spider web structure of FIG. 1 surrounded by a second, outer spider web structure, both poised for insertion into a helmet.

The embodiment of the invention shown in FIGS. 1, 2, and 3 includes only a single spider web structure 100. While highly advantageous when compared to conventional padding of the prior art, it may be desirable to add a second, spaced apart outer spider web structure 150. Referring now also to FIG. 4, there is shown an exploded, perspective, schematic view of the spider web structure 100 and the football helmet 114 of FIG. 1 with an intervening artificial spider silk outer web structure 150.

Unlike spider web structure 100, outer spider silk structure 150 is a basket-like structure formed by vertical bands 152*a*, 152*b*-152*n* of artificial silk. Horizontal artificial spider silk cross bands 154*a*, 154*b* . . . 154*n* are attached to vertical artificial spider silk bands 152*a*, 152*b*-152*n* at their intersections therewith. The designation 152*x* is used to designate any one of vertical bands 152*a*-152*n*

Ends of vertical artificial spider silk bands 152*a*, 152*b*-152*n* are typically removable attached to perimeter 108 of spider web structure 100 and, subsequently to football helmet 114 as described hereinabove. However, to retain a spaced apart relationship to spider web structure 100, resilient tethers 118 are required.

Figure 5:
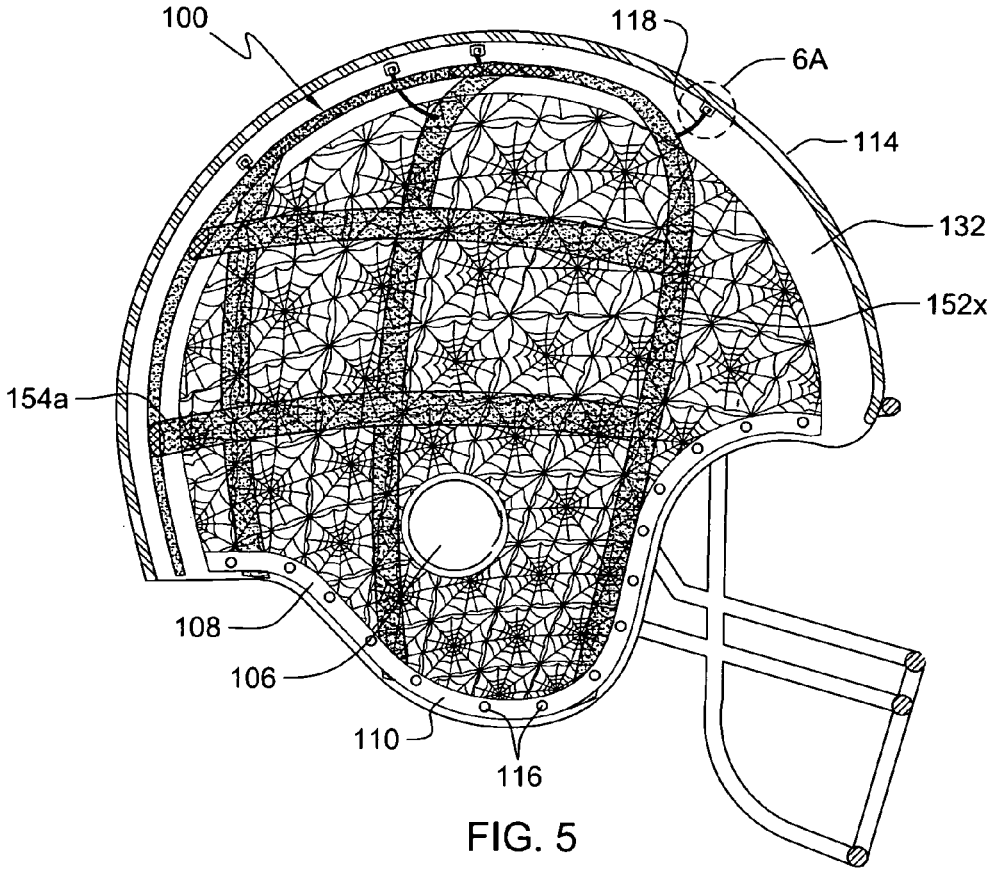
FIG. 5 is a side elevational, cross-sectional, schematic view of the spider web structures of FIG. 4 inserted into a helmet.

Referring now also to FIG. 5, there is shown a side elevational, cross-sectional, schematic view of spider web structure surrounded by outer artificial silk structure 150 installed in football helmet 114. Resilient tethers 118 are permanently connected to outer artificial spider silk structure 150 at their proximal ends 120. If outer artificial spider silk structure 150 is permanently attached to football helmet 114, then distal ends 122 of resilient tethers 118 may be permanently connected to an inner surface of football helmet 114. However, if outer artificial spider silk structure 150 is designed to be removably attached to football helmet 114, then a disconnectable attachment mechanism 124 must be used to connect distal ends 122 of resilient tethers 118 to football helmet 114.

Refer no also to FIGS. 6*a* and 6*b*. In one embodiment of such a disconnectable attachment, a ball 124 may be integrally formed at distal end 122 of resilient tethers 118. Ball 124 may then be received and retained in a spring loaded receptacle 126 with a safety lock 130 to prevent accidental release of ball 124. Receptacle 126 may be affixed to an inside surface 112 of helmet 114 with a strong adhesive, ultrasonic welding, or any other suitable attachment process material, none shown: Such materials and processes are believed to be well known to those of skill in the art and, consequently, are not further described or discussed herein.

In FIG. 6*a*, ball 124 is poised for inserting into receptacle 126. In FIG. 6*b*, ball 124 is positioned within receptacle 126 and safety lock 130 is in a closed, locked orientation.

It will be recognized that numerous alternative designs of an attachment such as a spring loaded receptacle may be substituted therefor. Consequently, the invention is not considered limited to the particular attachment (i.e., spring loaded, locking receptacle chosen for purposes of disclosure. Rather, the invention is intended to include any and all suitable devices for retaining a distal end of resilient tether 118 to football helmet 114.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A head-protecting liner for a helmet, comprising:

a) a net structure sized and shaped to surround a portion of a human head, comprising a first layer comprising a first plurality of spider web structures, each of said spider web structures having a plurality of spaced apart, outward radiating strands, a projection of each of said plurality of spaced apart, outward radiating strands converging at a central point of each respective said spider web structure, said plurality of spaced apart, outward radiating strands being connected to one another by a series of spaced apart cross strands disposed at increasing, discrete distances from said central point along each of said spaced apart, outward radiating strands, thereby forming polygonal shapes of ever increasing area centered around said central point, said spider web structure being formed from artificial spider silk, each of said spider web structures being joined one to another at respective edges thereof;

b) a binding affixed to at least a portion of a perimeter edge of said net structure; and c) a fastening system connected to said binding for securing said net structure to an interior region of a helmet.

2. The head-protecting liner for a helmet as recited in claim 1, wherein each of said first plurality of spider web structures has a size measured in an unstretched, relaxed state and wherein the size of at least one of said first plurality of spider web structures is measured in an unstretched, relaxed state different from the size measured in an unstretched, relaxed state of at least one other of said first plurality of spider web structures.

3. The head-protecting liner for a helmet as recited in claim 1, wherein each of said first plurality of spider web structures has a size measured in an unstretched, relaxed state and wherein the size of each of said first plurality of spider web structures is uniform when measured in an unstretched, relaxed state.

4. The head-protecting liner for a helmet as recited in claim 1, wherein said fastening system is selected from the group consisting of: a fastening system permanently affixing said net structure to said helmet, and a fastening system allowing said net structure to be selectively attached to and detached from said helmet.

5. The head-protecting liner for a helmet as recited in claim 4, wherein said fastening system comprises a fastening system for permanently affixing said net structure to said helmet, said fastening system comprising at least one selected from the group consisting of: an adhesive, stitching, and ultrasonic welding.

6. The head-protecting liner for a helmet as recited in claim 4, wherein said fastening system comprises a fastening system allowing selective attachment and removal of said net structure to and from said helmet, said fastening system comprising at least one selected from the group consisting of: snaps, a zipper, and a hook-and-loop fastening system.

7. The head-protecting liner for a helmet as recited in claim 4, wherein said fastening system comprises a plurality of first portions of a fastener disposed on said binding, said first fastener portions being adapted for removable interaction with corresponding second fastener portions affixed to said helmet.

8. The head-protecting liner for a helmet as recited in claim 1, further comprising:

d) basket-like outer structure surrounding and spaced apart from said net structure, said basket-like outer structure comprising a plurality of bands formed from a second plurality of spider web structures adjoined to one another at respective edges, said basket-like outer structure being attached to said net structure.

9. The head-protecting liner for a helmet as recited in claim 8, further comprising:

e) at least one resilient tether comprising both a proximal end and a distal end, one of said proximal end and said distal end being connected to an outer surface of said net structure and the other of said proximal end and said distal end being connected to an inner surface of said basket-like outer structure surrounding and spaced apart from said net structure.

10. The head-protecting liner for a helmet as recited in claim 8, wherein said plurality of bands comprise at least two vertical bands, said at least two vertical bands having each end thereof affixed to said binding, and at least one horizontal band interconnected to each of said at least two vertical bands at each intersection thereof.

11. The head-protecting liner for a helmet as recited in claim 8, wherein each of said second plurality of spider web structures has a size measured in an unstretched, relaxed state and wherein the size of at least one of said second plurality of spider web structures is measured in an unstretched, relaxed state different from the size measured in an unstretched, relaxed state of at least one other of said second plurality of spider web structures.

12. The head-protecting liner for a helmet as recited in claim 8, wherein each of said second plurality of spider web structures has a size measured in an unstretched, relaxed state and wherein the size of each of said second plurality of spider web structures is uniform when measured in an unstretched, relaxed state.

13. The head-protecting liner for a helmet as recited in claim 8, wherein said fastening system is selected from the group consisting of: a fastening system permanently affixing said net structure and said basket-like structure to said helmet, and a fastening system allowing said net structure and said outer basket-like structure to be selectively attached to and detached from said helmet.

14. The head-protecting liner for a helmet as recited in claim 13, wherein said fastening system comprises a fastening system for permanently affixing said net structure and said outer basket-like structure to said helmet, said fastening system comprising at least one selected from the group consisting of: an adhesive, stitching, and ultrasonic welding.

15. The head-protecting liner for a helmet as recited in claim 13, wherein said fastening system comprises a fastening system allowing selective attachment and removal of said net structure and said outer basket-like structure to and from said helmet, said fastening system comprising at least one selected from the group consisting of: snaps, a zipper, and a hook-and-loop fastening system.

16. The head-protecting liner for a helmet as recited in claim 8, wherein said fastening system comprises a plurality of first portions of a fastener disposed on said binding, said first fastener portions being adapted for removable interaction with corresponding second fastener portions affixed to said helmet.

* * * * *